United States Patent [19]

Sasaki et al.

[11] Patent Number: 4,586,650

[45] Date of Patent: May 6, 1986

[54] BLANK STRUCTURE WITH INDENTED FOLD LINES FOR A CARDBOARD CONTAINER

[75] Inventors: Kazuo Sasaki; Yoichi Nishiguchi; Shinzo Saito, all of Tokyo, Japan

[73] Assignee: JuJo Paper Co., Ltd., Tokyo, Japan

[21] Appl. No.: 746,885

[22] Filed: Jun. 20, 1985

[30] Foreign Application Priority Data

Sep. 13, 1984 [JP] Japan ..... 59-192227

[51] Int. Cl.[4] ..... B65D 5/40

[52] U.S. Cl. ..... 229/137; 229/3.1; 229/17 R; 229/DIG. 4

[58] Field of Search ..... 229/17 R, 17 G, 37 R, 229/DIG. 4, 3.1; 428/163, 167, 169, 172, 173

[56] References Cited

U.S. PATENT DOCUMENTS 1,876,063 9/1932 Kronenberger ..... 229/DIG. 4
3,098,599 7/1963 Hagan ..... 229/37 R
3,481,527 12/1969 Jacke ..... 229/37 R
3,727,825 4/1973 Troth ..... 229/DIG. 4

FOREIGN PATENT DOCUMENTS

82/04025 11/1982 PCT Int'l Appl. ..... 229/17 G
83371 5/1935 Sweden ..... 229/37 R

*Primary Examiner*—William Price
*Assistant Examiner*—Gary E. Elkins
*Attorney, Agent, or Firm*—Parkhurst & Oliff

[57] ABSTRACT

A blank structure for liquid having horizontal and vertical fold lines, bordered by specifically designed indented fold lines, the depth of grooves of the fold lines are gradually decreased toward the crossings of the respective fold lines. Thus, cracks or pinholes at the corners of the folded blank due to the folding stress in case of forming a container can be completely prevented.

8 Claims, 9 Drawing Figures

BLANK STRUCTURE WITH INDENTED FOLD LINES FOR A CARDBOARD CONTAINER

The present invention relates to a blank structure of flat composite cardboard comprising at least four rectangular lateral wall sections, top wall forming sections, bottom wall forming sections and auxiliary sections bordered by specifically designed indented fold lines to form a liquid container by folding or angularly bending the blank along the fold lines.

A cardboard liquid container is conventionally formed from a blank provided with indented fold lines by folding or angularly bending the blank along the lines. A web of cardboard to be used for such blanks is generally lined with a polyethylene layer, an aluminum foil layer and/or other appropriate layers which are bonded together to form a web of laminated composite cardboard. Such a cardboard can be delaminated when subjected to complex bending forces and this can constitute a significant drawback to a liquid container which is formed from a blank of this type of cardboard because, in the process of forming a container from such a blank, the seal fin adjacent to the bottom wall forming sections is folded, or bent by 180° to the said sections, toward inside along the fold line bordering the fin and then is further folded, or bent by 180° to the bottom wall, at the edges of the bottom wall toward the center in a direction which is perpendicular to the said fold line, rendering itself, more particularly its doubly folded areas, subject to added effects of a force which is innate within the blank and tries to restore it to the original flat state and a force which is exerted by the bonding agent on the seal fin and tries to keep in in the folded state. Delamination of seal fin can eventually result in ruptures and other openings along the fold line, through which liquid or gas contained in the container may leak to the outside.

The areas of a blank which are most susceptible to delamination are those surrounding the crossings of the vertical fold lines running all the way through the blank and bordering the lateral wall sections, the bottom wall forming sections and the seal fin sections and the horizontal fold line bordering the bottom seal fin. Solutions to prevent delamination in those areas of a cardboard container of the kind involved are proposed in the Japanese Patent Application No. 54-113452. FIGS. 7 and 8 of the accompanying drawing illustrate the proposed solutions, of which the one illustrated in FIG. 8 consists of breaking the vertical fold line 40 and the horizontal fold line 41 at and around the crossing 42 of said fold lines and forming short auxiliary indented crease lines 43, 43 parallel to the horizontal fold line 41 at the upper and the lower ends of the break of the vertical fold line 40 respectively, while the illustrated in FIG. 7 consists of breaking vertical fold line 40 at and near the crossing 45 of the horizontal fold line 44 and the vertical fold line 40 and forming short auxiliary indented crease lines 43, 43 parallel to the horizontal fold line 44 at the upper and the lower ends of the break of the vertical fold line 40 respectively, in the latter case the horizontal fold line 44 having no break at or near the crossing 45 and forming a continuous straight line.

Whereas introduction of said auxiliary crease lines 43, 43 into a blank of a cardboard liquid container greatly reduces possibility of delamination at and around the doubly folded areas of the bottom seal fin and other areas which are subject to a considerable stress when the container is in use as compared with a cardboard liquid container without such auxiliary crease lines, it can not completely eliminate occurence of ruptures and other openings.

Besides, with the modified structure of a blank as illustrated in FIG. 7, there are three parallel lines including the horizontal fold line 44 and the two auxiliary crease lines 43, 43 in close proximity to the crossing 45 and, with the other modified structure of a blank as illustrated in FIG. 8, there are total of six extremities of lines including extremities 46, 46 of the broken horizontal fold line 41 and extremites 47, 47 of the two parallel auxiliary crease lines 43, 43 in close proximity to the crossing 42. It should be noted that a number of fold lines are forcefully indented in the vicinity of a crossing of indented lines, and that a relatively large number of extremities of indented lines are located within a small area can give rise to easy ruptures in the thermoplastic synthetic resin layers on both sides of the blank as well as in the aluminum foil layer bonded to the inner surface of the inner thermoplastic synthetic resin layer of a cardboard liquid container.

The aforementioned disadvantages of conventional cardboard liquid containers are completely eliminated in a cardboard liquid container formed from a blank structure with indented fold lines according to the present invention, in which the blank structure of flat composite cardboard comprising at least four rectangular lateral wall sections, a top wall forming sections, a bottom wall forming sections and auxiliary sections bordered by specifically designed indented fold lines to form a liquid container by folding or angularly bending the blank along the fold lines, is characterized by that at least either of the horizontal fold line or the vertical fold line forming a crossing has a groove whose depth is gradually decreased as it approaches the crossing, that said vertical fold line is provided with a pair of short and indented auxiliary crease lines forming a pair of small arcs with a radius of curvature of a few millimeters which are convexly facing each other and that the depth of the grooves of said indented auxiliary crease lines is gradually decreased as they approach their respective extremities.

A cardboard liquid container formed from a blank structure of flat composite cardboard according to the present invention is almost completely free from occurenece of ruptures and other openings at the corners and/or along the edges of the container that can be caused by the stress due to folding the blank to form a liquid container and through which the liquid contained in the container can leak. Because a blank structure of flat composite cardboard according to the present invention does not have a number of fold lines indented in a close vicinity of a crossing of indented lines nor does it have a relatively large number of extremities of indented lines located within a small area surrounding a crossing of indented lines that can give rise to ruptures in the thermoplastic synthetic resin layers (e.g. polyethylene layers) of the blank or any deterioration of the thermoplastic synthetic resin layers of the blank that can result in ruptures in said layers.

A cardboard liquid container formed from a blank structure of flat composite cardboard according to the present invention is further free from occurence of ripples and fissures at or around the doubly folded areas of the bottom seal fin of the blank because the depth of grooves of the indented fold lines in said areas is gradually decreased to become flat as the lines approach to their respective extremities quite unlike fold lines of a conventional blank which have an equal groove depth throughout the lines and are abruptly broken to form flat areas beyond the extremities of fold lines.

Preferred embodiments of blank structure with indented fold lines for a cardboard container according to the present invention are illustrated in the accompanying drawing, in which FIG. 1 shows an enlarged partial plane view of an embodiment of blank structure according to the present invention illustrating an area surrounding an crossing of a vertical fold line and a horizontal fold line;

Figure 4:
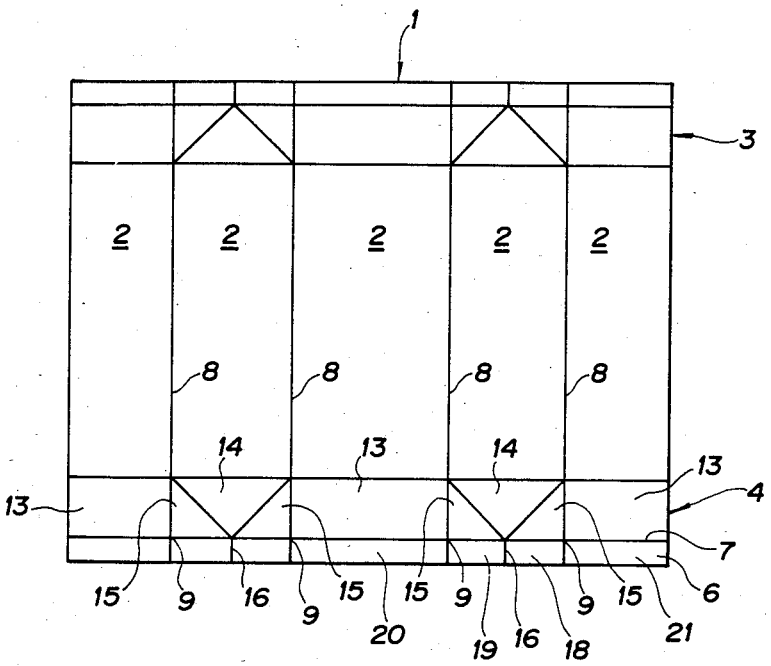
FIG. 4 shows a schematic plane view of a blank.
Figure 5:
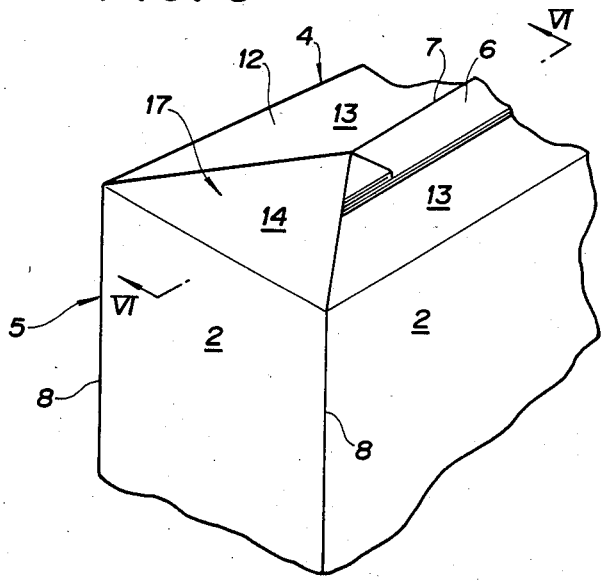
FIG. 5 shows a perspective view of the bottom of a cardboard liquid container formed from the blank illustrated in FIG. 4.

As most clearly seen in FIG. 4, a blank which is generally indicated by (1) comprises four or five rectangular lateral wall sections (2), top wall forming sections (3) and bottom wall forming sections (4) which are bordered by indented fold lines. FIG. 5 shows a perspective view of the bottom of a cardboard liquid container formed from the blank illustrated in FIG. 4.

Adjacent to said top wall forming sections (3) and bottom wall forming sections (4) are provided respective seal fins (6) with respective interposed bordering horizontal indented fold lines (7), said horizontal fold lines being perpendicularly intersected by vertical indented fold lines (8) bordering the adjoining lateral wall sections (2) and extending further to the upper and lower ends of the blank. As seen from FIG. 2 and FIG. 3, the depth of the grooves of horizontal fold line (7) and vertical fold line (8) is gradually decreased as they approach the rectangular crossing (9) to a very reduced dimension. Alternatively, as shown in FIG. 1A, the depth of either the groove of horizontal fold line (7) or that of vertical fold line (8), or of the grooves of the both lines can be decreased to come to the surface of the blank within an area encompassing few millimeters around the crossing (9).

Figure 1:
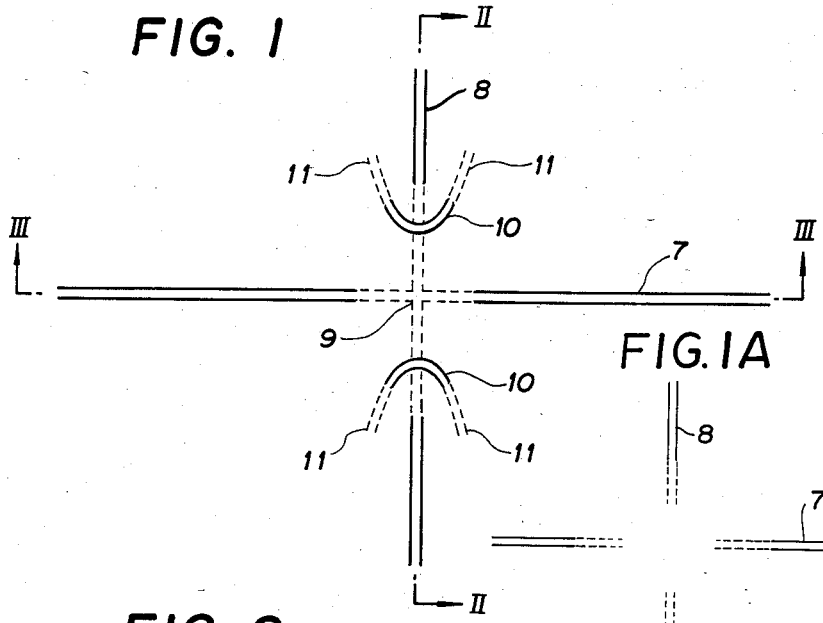
FIG. 1A shows an enlarged partial plane view of another embodiment of blank structure according to the present invention illustrating an area surrounding an crossing.
Figure 1A:
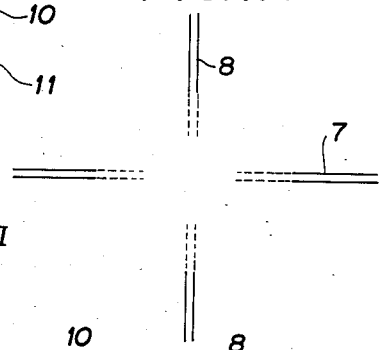
Figure 2:
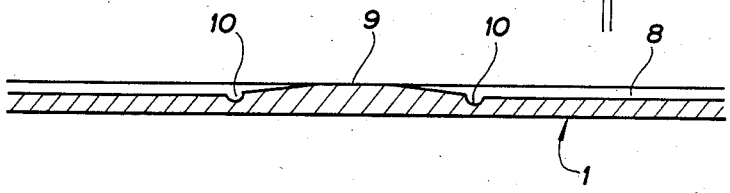
FIG. 2 shows an enlarged sectional view of the first embodiment along II—II line of FIG. 1.

As seen in FIG. 1 and FIG. 2, said vertical fold line (8) is provided with a pair of short and indented auxiliary crease lines (10) in the shape of curved gutters forming a pair of small arcs with a radius of curvature of a few millimeters which are convexly facing each other at above and below the crossing (9). The depth of groove of the curved auxiliary crease lines is gradually decreased toward the extremities (11) of the lines.

To form flat bottom wall (12) of cardboard liquid container (15) as shown in FIG. 5, from collectivity of bottom wall forming sections (4) of a blank (1) as described above, rectangular bottom wall forming sections (13) are put together in face-to-face relationship and then rectangularly bent at fold line (7) to make the flat bottom wall (12). By this folding operation, triangular sections (14), (15) which are adjacent to the bottom wall forming sections (13) and bordered by the vertical fold line (8) are pushed outside at the both lateral sides of the bottom wall (12) to from triangular lugs at a lateral side of the bottom. The triangular sections (14), (15) which are now contacted in face-to-face relationship are then heat-sealed. The seal fins (6) which are adjacent to the bottom wall forming sections (13) and the triangular sections (14), (15) with the interposed horizontal fold line (7) is folded at seal fin vertical fold lines (16) into two halves, which are subsequently heat-sealed to become airtight. The heat-sealed seal fin (6) is then folded at the horizontal fold line (7) to either side to become contacted with the bottom wall forming section (13) of that side of the bottom and heat-sealed to said bottom wall forming section (13). The triangular sections (14), (15) that have been pushed outside to form triangular lugs, are folded inside as shown in FIG. 5 to be in contact with the bottom seal fin (6) and the bottom wall forming sections (13) and heat-sealed thereto to form a flat bottom 4.

Figure 6:
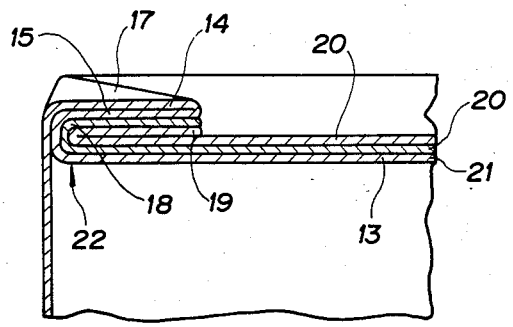
FIG. 6 shows an enlarged sectional view of the container of FIG. 5 along VI—VI line.
Figure 7:
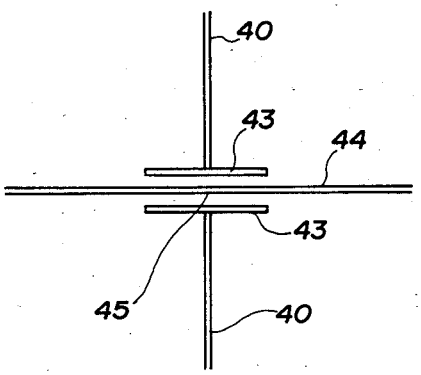
PRIOR ART FIG. 7
FIG. 7 and FIG. 8 show enlarged partial plane views of two different embodiments of blank structure according to the prior art illustrating areas corresponding to FIG. 1.
Figure 8:
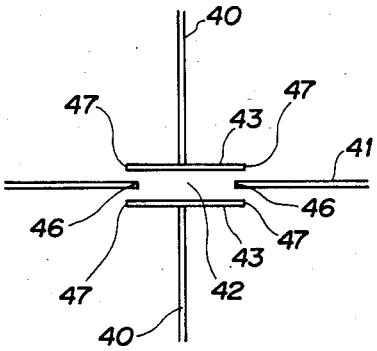
PRIOR ART FIG. 8

Thus, as seen in FIG. 5 and FIG. 6, at the triangular lug area (17), there are total of seven layers of cardboard blank sections including, from outside to inside, the larger triangular section (14), the smaller triangular section (15), fold sections (18), (19) of the seal fin (6) which are adjacent to the smaller triangular section (15), folded sections (20), (21) of the seal fin (6) which are adjacent to the bottom wall forming sections (13), (13) and the bottom wall forming sections (13) with a very high bending stress appearing concentratedly at the corner of folding (22) as seen in FIG. 6. Such a high stress can easily result in ruptures and other openings at or around the corners of folding of a cardboard liquid container of conventional design that has disadvantages as described earlier.

Figure 3:
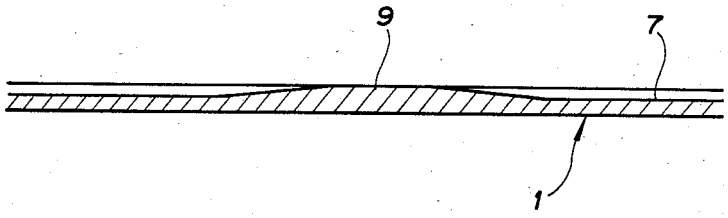
FIG. 3 shows an enlarged sectional view of the first embodiment along III—III line of FIG. 1.

A blank structure of flat composite cardboard according to the present invention is characterized in that, as seen from FIG. 2 and FIG. 3, the depth of the grooves of the horizontal fold line (7) bordering the bottom seal fin (6) and any one of the vertical fold lines (8) is gradually decreased as they approach the rectangular crossing (9), as most clearly shown in FIGS. 1 and 4, from points (23), (24) which are located a certain distance away from the crossing (9) from a value which is common to all the grooves of the blank to zero at the crossing and by that said vertical hold line (8) is provided with a pair of short and indented auxiliary crease lines (10) forming a pair of small arcs of a quarter of a circle or a semicircle with a radius of curvature of a few millimeters which are convexly facing each other at above and below the crossing (9). Said auxiliary crease lines can also take a form of curved gutters.

It should be noted that the depth of said auxiliary crease lines (10) preferably decreases as they approach their respective extremities (11).

As described earlier, a conventional blank of a cardboard liquid container having indented fold lines with a constant depth of grooves is subject to a high stress particularly at or around the corners produced by folding the triangular lugs, giving rise to ruptures and other openings through which liquid contained in the container can leak out, whereas a blank structure of a cardboard liquid container according to the present invention is almost completely free from such ruptures and other openings since it is provided with indented fold lines the depth of grooves of which is gradually decreased as they approach crossings of the lines to almost zero in order to minimize the stress to be generated at the corners of folding as well as with auxiliary crease lines along the vertical fold lines at or near the crossings in order to scatter the stress to be generated by folding the blank. Additionally, by decreasing the depth of auxiliary crease lines as they approach their respective extremities, generation of torsion or wrinkling of the container at the corners of folding can be prevented even when the blank is heavily bent at the triangular lugs. Hence, occurence of ruptures and other openings at these locations are rendered minimal and a cardboard liquid container which is free from leakage of contained liquid can be provided.

What is claimed is:

1. A blank structure of flat composite cardboard for a cardboard container, comprising at least four rectangular lateral wall sections, top wall forming sections, bottom wall forming sections and auxiliary sections bordered by specifically designed indented fold lines, the depth of grooves of said indented fold lines being gradually decreased as they approach at least one of a plurality of crossings of said indented fold lines.

2. A blank structure of flat composite cardboard for a cardboard container according to claim 1, wherein the depth of grooves of said indented fold lines is decreased to almost zero within an area encompassing a few millimeters around any one of said crossings.

3. A blank structure of flat composite cardboard for a cardboard liquid container, comprising four to five rectangular lateral wall sections, top wall forming sections, bottom wall forming sections and auxiliary sections including a bottom seal fin which is adjacent to said bottom wall forming sections and a top seal fin which is adjacent to said top wall sections both of which are bordered by respective horizontal and vertical indented fold lines, said horizontal and vertical indented fold lines running perpendicularly to one another to form rectangular crossings and the depth of grooves of said horizontal and vertical fold lines being decreased as they approach their respective crossings.

4. A blank structure of flat composite cardboard for a cardboard container according to claim 3, wherein the depth of a groove of at least one of said fold lines is decreased to almost zero as they approach to the crossings within an area encompassing a few millimeters from the crossings.

5. A blank structure of flat composite cardboard for a cardboard container according to claim 3, wherein said vertical fold lines are provided with a pair of short and indented auxiliary crease lines which form a pair of small arcs with a radius of curvature of a few millimeters facing convexly each other.

6. A blank structure of flat composite cardboard for a cardboard container according to claim 3, further comprising a plurality of indented auxiliary crease lines whose depth of grooves decrease as they approach the extremities.

7. A blank structure of flat composite cardboard for a cardboard container according to claim 3, further comprising a top wall forming section and a bottom wall forming section having triangular sections bordered by respective triangular lugs.

8. A blank structure of flat composite cardboard for a cardboard container according to claim 3, wherein said blank structure is a laminated composite cardboard sheet comprising layers of polyethylene, a layer of aluminum foil which are bonded together to the cardboard.

* * * * *